US011332921B2

(12) United States Patent
Ustinov

(10) Patent No.: US 11,332,921 B2
(45) Date of Patent: May 17, 2022

(54) CONSTRUCTION SYSTEM FOR A BUILDING MODULE

(71) Applicant: UHCS PROPERTY SA, Suisse (CH)

(72) Inventor: Igor Ustinov, Lausanne (CH)

(73) Assignee: UHCS PROPERTY SA, Sion (CH)

( * ) Notice: Subject to any disclaimer, the term of this patent is extended or adjusted under 35 U.S.C. 154(b) by 0 days.

(21) Appl. No.: 16/649,669

(22) PCT Filed: Sep. 28, 2018

(86) PCT No.: PCT/EP2018/076538
§ 371 (c)(1),
(2) Date: Mar. 23, 2020

(87) PCT Pub. No.: WO2019/063828
PCT Pub. Date: Apr. 4, 2019

(65) Prior Publication Data

US 2020/0224405 A1 Jul. 16, 2020

(30) Foreign Application Priority Data

Sep. 29, 2017 (CH) ..... 01195/17

(51) Int. Cl.
*E04B 1/28* (2006.01)
*E04B 1/19* (2006.01)
(Continued)

(52) U.S. Cl.
CPC ..... *E04B 1/28* (2013.01); *E04B 1/1912* (2013.01); *E04C 3/28* (2013.01); *E04C 3/36* (2013.01); *E04B 2001/199* (2013.01)

(58) Field of Classification Search
CPC ..... E04B 2/7818; E04B 2/766; E04B 2002/7461; E04B 2002/7487;
(Continued)

(56) References Cited

U.S. PATENT DOCUMENTS 4,707,959 A * 11/1987 Stoakes ..... E04B 2/965 52/235
6,006,489 A * 12/1999 Zadok ..... E04B 1/0046 52/204.53
(Continued)

FOREIGN PATENT DOCUMENTS

DE 202016100558 5/2017
EP 0320745 6/1989

*Primary Examiner* — Gisele D Ford

(57) ABSTRACT

The present invention concerns a construction system for a building module, whose main elements are made of plastic material, providing a robust construction in an easy and quick manner. The system includes a set of main beams (1) adapted to be assembled end-to-end to form an open structure in the shape of a 3-dimensional rectangular frame. The system further includes secondary beams (11), adapted to be assembled between parallel and opposite main beams, and flat facade elements (3) insertable against each other between two adjacent parallel beams. Each facade element (3) includes a rectangular flat plate provided with two folded opposite edges (3A) intended to be hooked with adjacent parallel beams. Each main beam has a rectangular cross-section including, on the four sides thereof, a projection (21) parallel to the side and spaced therefrom leaving an opening to receive a folded edge of a flat facade element. Each secondary beam (11) includes, on two opposite faces, at least one projection leaving an opening to receive a folded edge of a flat facade element (3).

10 Claims, 9 Drawing Sheets

(51) Int. Cl.
*E04C 3/28* (2006.01)
*E04C 3/36* (2006.01)

(58) Field of Classification Search
CPC ..... E04B 2/7407; E04B 2/08; F16B 5/0685; F16B 7/187; E04C 2003/0439; E04C 2003/0465
See application file for complete search history.

(56) References Cited

U.S. PATENT DOCUMENTS 8,572,928 B2 * 11/2013 Bruder ..... E04B 2/7818 52/775
8,789,325 B2 * 7/2014 Verhaeghe ..... E04B 2/08 52/233
9,874,011 B2 * 1/2018 Oliveira ..... E04B 2/761
2005/0034378 A1 * 2/2005 Underwood ..... A47B 46/005 52/36.1
2005/0235585 A1 * 10/2005 Green ..... E06B 3/285 52/204.5
2007/0197082 A1 * 8/2007 Zeh ..... E04B 2/7433 439/404
2007/0266655 A1 * 11/2007 Howe ..... E04B 1/58 52/282.1
2007/0283630 A1 * 12/2007 Kasdorf ..... E04B 2/7845 52/36.1
2008/0104922 A1 * 5/2008 Glick ..... E04B 2/7425 52/630
2013/0034383 A1 * 2/2013 Chong ..... E04B 1/24 403/231
2013/0091691 A1 * 4/2013 Oetlinger ..... F16B 12/50 29/525.02
2014/0250822 A1 * 9/2014 Oetlinger ..... F16B 7/187 52/656.9
2015/0010343 A1 * 1/2015 Flaig ..... B23P 19/04 403/188
2016/0341229 A1 * 11/2016 Ou ..... F16B 12/02
2018/0058067 A1 * 3/2018 Lake ..... E04C 3/06
2018/0180077 A1 * 6/2018 White ..... F16B 7/187

* cited by examiner

CONSTRUCTION SYSTEM FOR A BUILDING MODULE

The present invention relates to a construction system for a building module, in particular a dwelling or a garage, whose main elements are made of plastic material.

It is already known from the state of the art of the packaging of products to create assemblies made essentially of plastic material. WO0212077 describes a bottle made of molded plastic material having connection means such that the bottle can be connected side-by-side to another bottle by connection means such as, for example, dovetails. The bottles can also be assembled on top of each other, thus allowing assemblies of bottles to be made.

WO2012045061 is also known, which describes devices and containers which are extensible, modular, and which can be interlocked, laterally and vertically, with other similar containers for a variety of applications.

Individuals are also known who have undertaken and made constructions such as houses based on plastic bottles and in most cases, the bottles are placed horizontally.

Traditional construction systems, based on bricks for example, are also known and very common, however, the cost of a construction remains significant.

Moreover, the applicant has filed a patent application, number CH707115, for a bottle adapted for assembly with other bottles in order to make a construction. These bottles have a shape with a male/female frusto-conical portion.

The applicant has also filed another patent application, number CH708086, for a bottle including at the upper portion thereof a male cylindrical double neck including first mechanical coupling means which can be actuated by rotation. The lower portion of the bottle includes a cylindrical double neck including second mechanical coupling means which can be actuated by rotation and complementary to said first mechanical actuating means. The upper portion of a bottle can be coupled into the lower portion of another bottle by the double action of the male and female necks in order to bring the respective bearing surfaces into contact. The bottle has at the periphery thereof, at least one longitudinal female opening allowing an intermediate rod to be inserted, said rod serving as a link between two bottles disposed next to each other or to a bottle and to another element of longitudinal female opening construction.

These two patent applications are based on the assembly of bottles of a particular shape in order to form a rigid formwork possibly with increased rigidity and improved sealing.

WO2016016706 describes a construction system including a set of accessory elements and a set of bodies of elongated shape intended to make a construction by assembling a plurality of said bodies with accessory elements. The body of elongated shape includes a front face and a rear face, which are planar and opposite, an upper face and a lower face, which are planar and opposite, and two opposite lateral faces. At least one of said two lateral faces has a recessed portion, in particular a curvature on the central portion thereof.

Each body can be assembled with another body, by their lateral faces therebetween and/or by the assembly of a lower face of one body on the upper face of another body and/or by the assembly of a lateral face of one body with the front or rear face of another body. The accessory elements are elongated parts which are inserted between and in contact with the recessed portions of the two elongated bodies assembled face-to-face, and which extend along all or a substantial portion of the height of the elongated bodies. In the case of hollow elongated parts or by cooperation of these elongated parts with face-to-face recessed parts of the elongated bodies, the elongated parts alone define a central space located between and in the middle of the recessed parts of the elongated bodies. The elongated parts further define lateral spaces between the lateral faces of the recessed parts of the elongated bodies on either side of the elongated parts.

EP0320745A1 and EP1321592A1 describe construction systems whose main elements are made of plastic materials including rectangular cross-section beams with profiles of different shapes.

Moreover, construction systems are known, composed of parts made of plastic materials, but which are intended for the construction of small-scale models.

The present invention allows a construction system to be made for a building module whose main elements are made of plastic material, in particular recycled plastic material, allowing a robust construction to be produced very simply and very quickly.

In accordance with the invention, this object is achieved thanks to a construction system for a building module, in particular a dwelling or a garage, whose main elements are made of a plastic material, including a set of extruded, hollow profile main beams, of an elongated rectilinear shape, of a rectangular uniform cross-section and of an adequate length. These main beams are adapted to be assembled end-to-end to form a rectangular or cubic open structure in the shape of a 3-dimensional rectangular or cubic frame. The construction system further comprises a plurality of intermediate secondary beams, adapted to be assembled between parallel and opposite main beams of a rectangular frame, and a plurality of flat facade elements insertable against each other between two adjacent parallel beams, each outer or inner facade element including a rectangular flat plate provided with two folded opposite edges intended to be hooked with adjacent parallel beams.

In the inventive system, each rectangular cross-section main beam includes, on the four sides thereof, a projection parallel to the side and spaced away from a portion of the side disposed towards the central portion thereof, leaving an opening towards each corner of the main beam to receive a folded edge of a flat facade element.

Each secondary beam includes, at least on two opposite faces, at least one projection leaving an opening to receive a folded edge of a flat facade element.

Preferably, the parallel projections on each side of the rectangular section of each main beam extend beyond the adjacent side of the rectangular section. Also, each main beam, preferably includes on each side, two projections parallel to the side and spaced therefrom, the two projections being divided by a central opening.

In one embodiment, the secondary beams include a central hollow core, preferably square, and projections extending on either side of this hollow core to define on each side, at least one opening for receiving the folded edge of a flat facade element. Preferably, each side of the hollow core of a secondary beam includes a central projection bordered by two lateral projections, defining therebetween two openings to receive the folded edge of a flat facade element. In one embodiment, the two lateral projections include at the outer end thereof, an edge which is outwardly-folded and recessed relative to the outer end of the central projection, by a distance which corresponds to the thickness of a flat facade element. Optionally, the other edges of the hollow core include reinforcing profiles.

In the inventive system the main beams can be assembled by means of corner parts disposed between the adjacent ends of the main beams. These corner parts may include a square section rod, shorter than the main beams, and insertable into the end of a first main beam. One end of this rod includes a longitudinal groove in the center of each face of the square rod and intended to receive a projection on a junction element insertable into the end of a second main beam which can be assembled end-to-end with the first.

Each rectangular open structure in the shape of a 3-dimensional rectangular frame, may constitute a construction module which can be assembled with another module, each module measuring between 2.5 m and 4.5 m in side length and width and between 2.5 m and 3.5 m in height.

Optionally, the flat facade elements include, in the flat plates thereof, extractable areas for creating openings.

In one embodiment, the outer and inner flat facade elements include two flat plates spaced from each other to form a formwork. The plates can be screwed, riveted or glued onto the main beams and the secondary beams.

For more rigidity, each beam and optionally the formwork of each facade element, is filled with a substance for solidifying the structure thereof, for example earth mixed with a hardening resin, cement, concrete, adobe or any other hardening substance, or even a porous material such as a rigid foam.

Preferably, and for ecological concerns, the construction system is made from recycled plastic materials.

Another aspect of the invention is an extrusion method for manufacturing the system under a carbon dioxide atmosphere in a subcritical cycle or with a hardening means.

The invention also concerns an assembly of a building construction module built from a construction system according to all the described variants thereof, the assembly including:

a. At least one construction module consisting of a three-dimensional rectangular or cubic frame of main beams, b. An assembly of secondary beams between parallel main beams, and c. An assembly of flat facade elements inserted between two parallel beams, the folded edges of the facade elements being inserted into said parallel openings.

In a variant of the present assembly, secondary beams are disposed vertically, parallel to and between the vertical main beams, and the facade elements are placed on top of each other between two vertical parallel beams.

With such an assembly, when elements of corner assemblies are sealed to the ground, the flat facade elements resist wind of at least 160 kg/m$^2$, support ground loads of at least 224 kg/m$^2$ and support loads on the upper portion of the module of at least 107 kg/m$^2$.

When a second construction module is arranged on a first construction module, the elements of the corner assembly of the first construction module being sealed to the ground, the flat facade elements resist wind of at least 182 kg/m$^2$, support loads on the ground of at least 224 kg/m$^2$ and the flat facade elements of the second module support loads on the upper portion of said second module of at least 107 kg/m$^2$.

With these assemblies, the upper portion of the module of a dwelling can be made leak-tight, either by mounting the flat facade elements or by positioning a tarpaulin on which a polymerizing resin can be applied, making said tarpaulin rigid and waterproof.

In another embodiment, the upper portion of the module of a dwelling can be made leak-tight, by the addition of a conventional roof.

Said assembly usually constitutes an element of an apartment block, for instance, a garage, a house. Therefore, the invention also covers a building, in particular an apartment block, for instance a house or a garage, including such an assembly.

The features of the invention will appear more clearly on reading the following non-limiting description of several embodiments given only by way of example, with reference to the schematic figures, in which.

Figure 9:
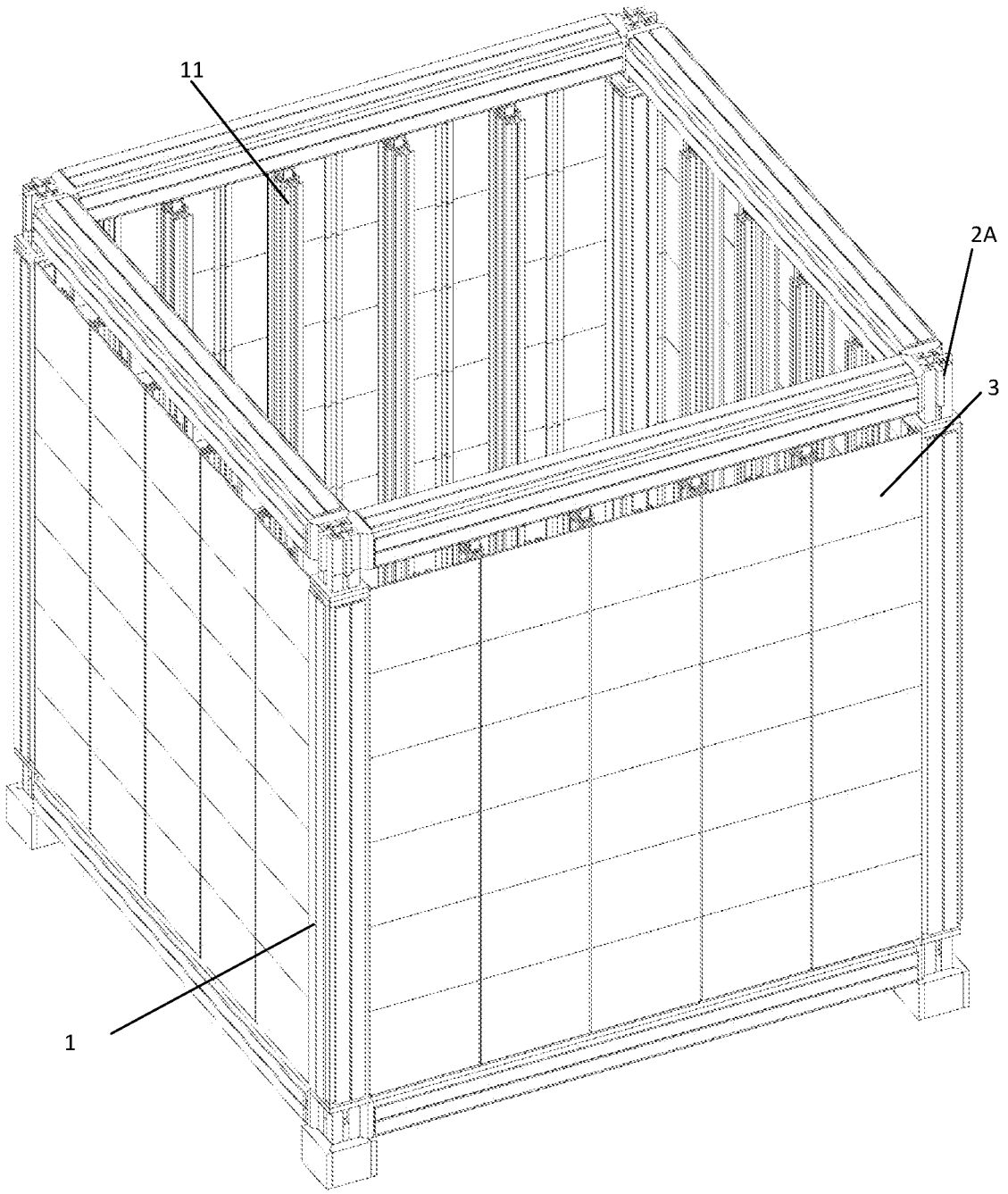
FIG. 9 represents a perspective view of a construction module without the upper portion.

A module of a dwelling as illustrated in FIG. 9, whose main elements are made of plastic material include a set of extruded, hollow profile main beams 1, of an elongated rectilinear shape, of a uniform cross-section and of an adequate length. These main beams 1 are adapted to be assembled end-to-end to form a rectangular open structure in the shape of a 3-dimensional rectangular frame. A plurality of intermediate secondary beams 11, which are adapted to be assembled between parallel and opposite main beams 1 of a rectangular frame. The module includes a plurality of flat facade elements 3 insertable against each other between two adjacent parallel beams 1, 11, each facade element 3 including a rectangular flat plate provided with two folded opposite edges 3A, 3B (FIG. 5) which are to be hooked with adjacent parallel beams 1, 11.

Figure 1:
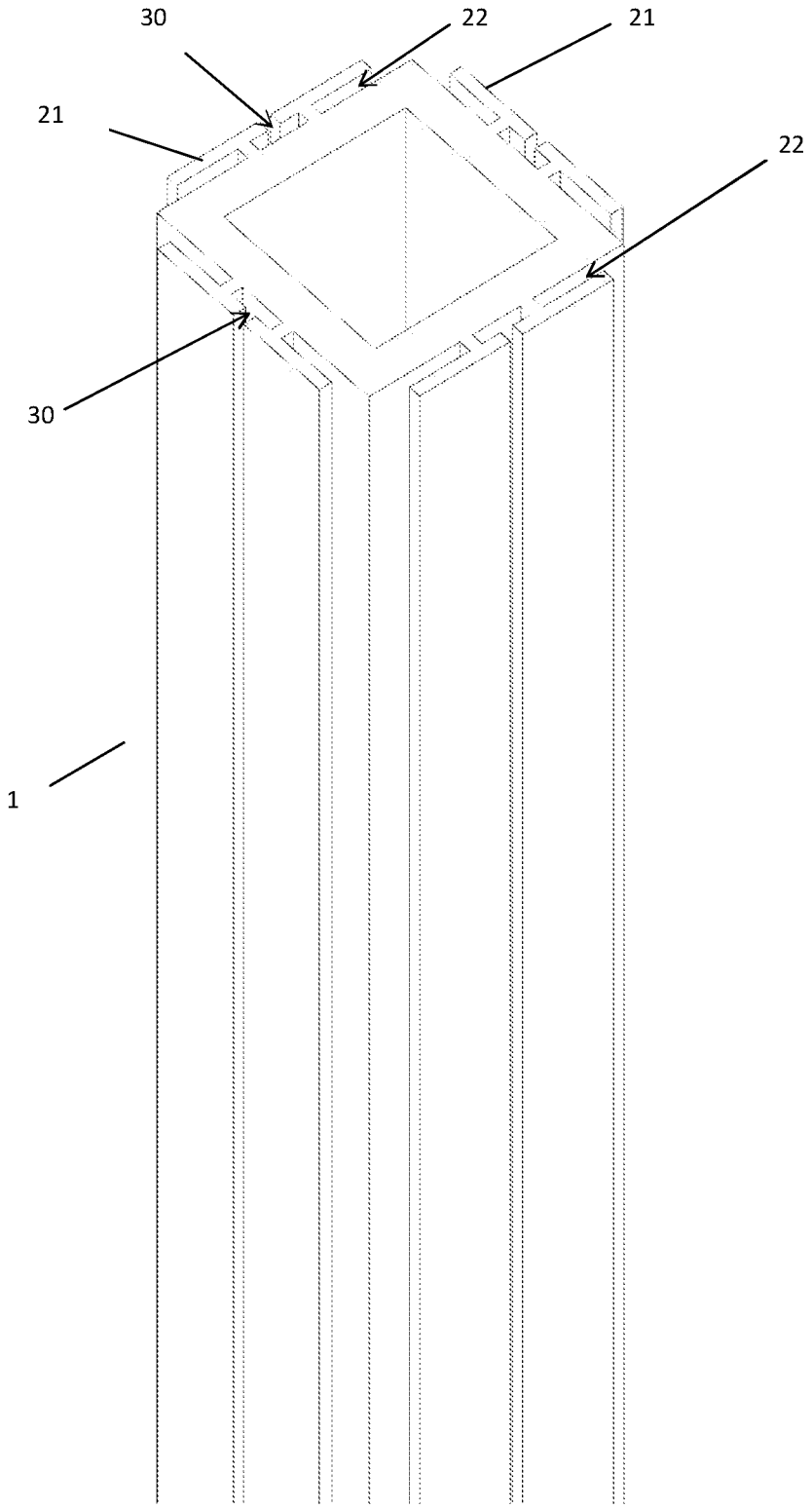
FIG. 1 represents a partial perspective view of a main beam.
Figure 5:
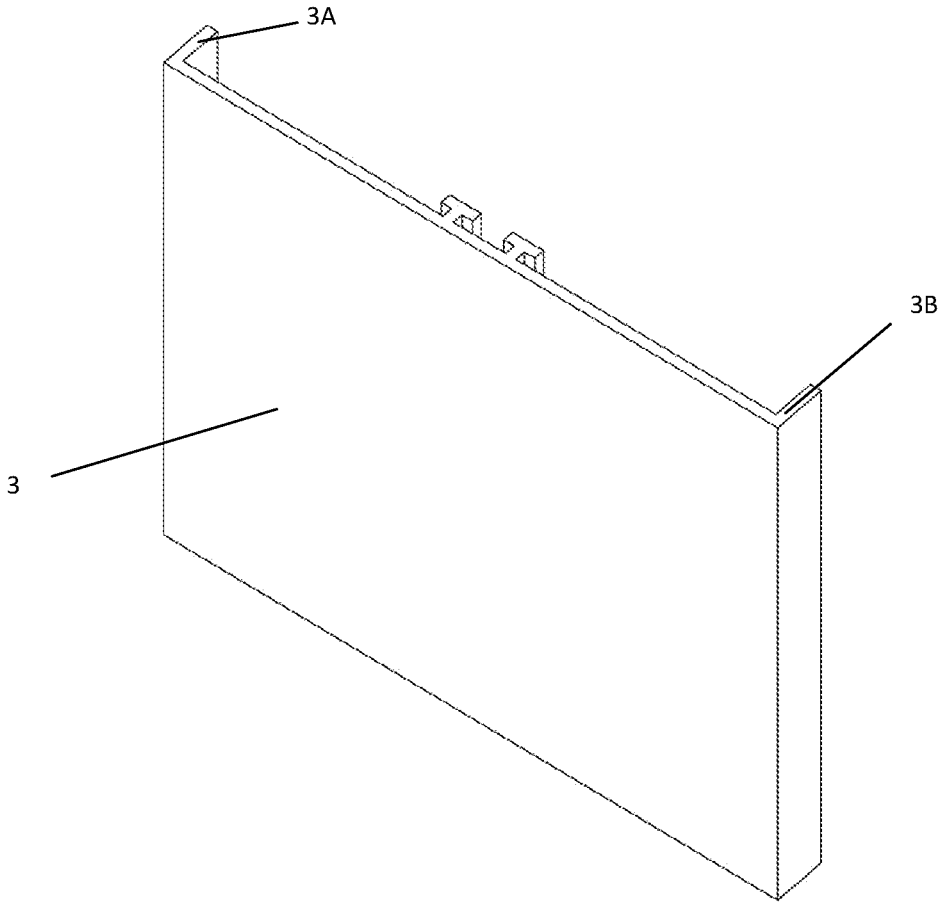
FIG. 5 represents a perspective view of a facade element.

As illustrated in FIG. 1, each main beam 1 has a rectangular cross-section including, on the four sides thereof, one or two projections 21 parallel to the side and spaced from a side portion disposed towards the central portion thereof, leaving towards each corner of the main beam 1, an opening 22 to receive a folded edge 3A, 3B (FIG. 5) of a flat facade element 3 (FIG. 5). The parallel projections 21 on each side of the rectangular section of each main beam 1, extend beyond the adjacent side of the rectangular section. In the illustrated embodiment, each main beam 1 includes, on each side, two projections 21 parallel to the side and spaced therefrom, the two projections 21 being divided by a central opening 30.

Figure 2:
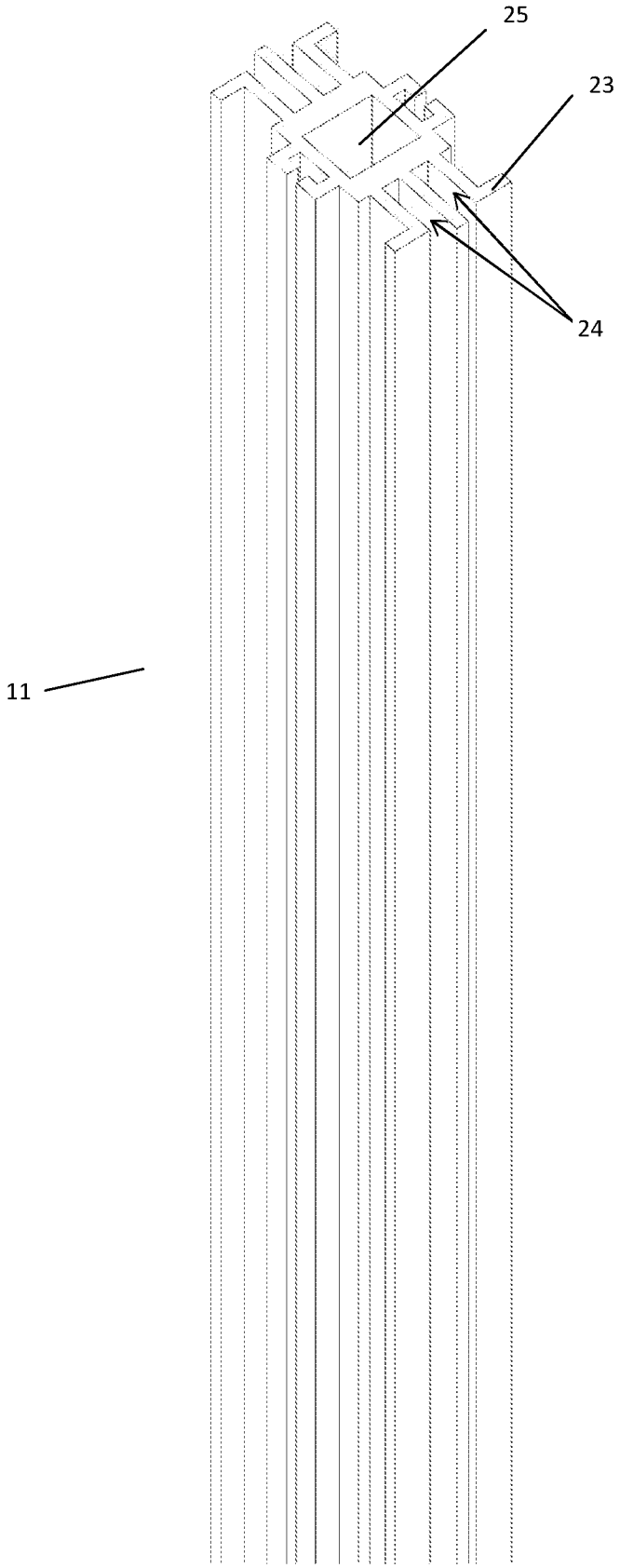
FIG. 2 represents a partial perspective view of a secondary beam.

As illustrated in FIG. 2, each secondary beam 11 includes, on two opposite faces, projections 23 leaving an opening 24 to receive a folded edge 3A, 3B (FIG. 5) of a flat facade element 3 (FIG. 5). The secondary beams 11 include a square central hollow core 25 and projections 23 extending on either side of this hollow core 25 to define on each side, an opening 24 to receive the folded edge of a flat facade element. Each side of the hollow core of a secondary beam 11 includes a central projection bordered by two lateral projections 23 defining therebetween, two openings 24 for receiving the folded edge of a flat facade element. In one embodiment, the two lateral projections 23 include at their outer end, an edge which is outwardly-folded and recessed relative to the outer end of the central projection, by a distance which corresponds to the thickness of a flat facade element. In this embodiment, the other edges of the hollow core include reinforcing profiles.

As illustrated in FIGS. 3, 4A, 4B, 6 and 7, corner parts 2A, 2B, 2C, 2D allow, assembling the main beams to each other and to secondary beams.

Figure 3:
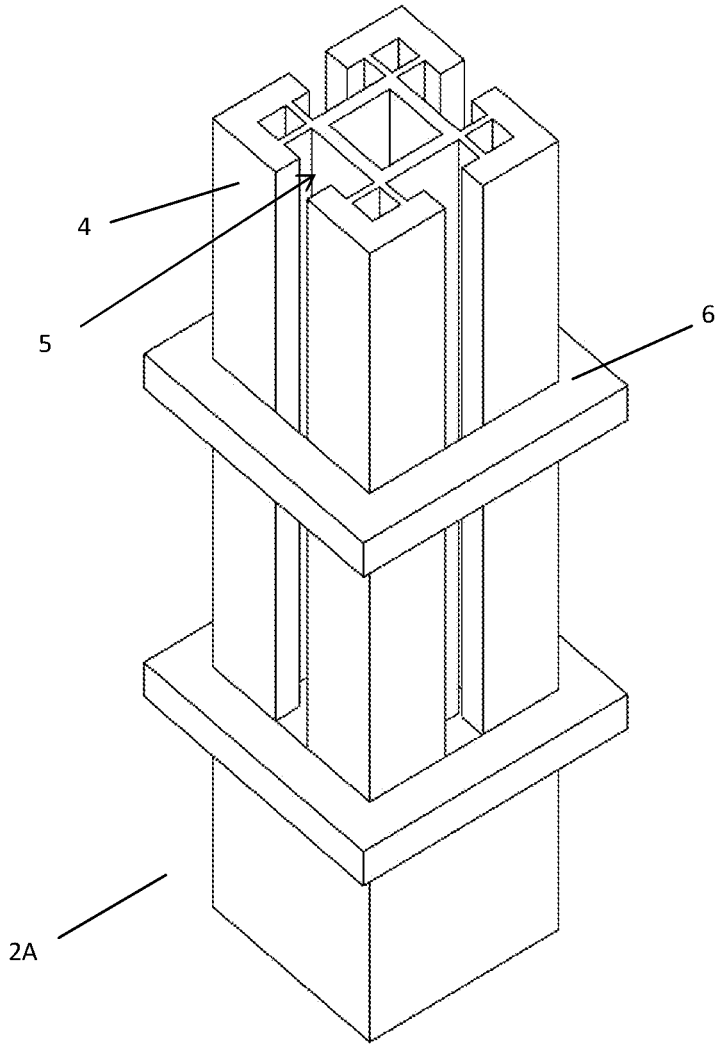
FIG. 3 represents a perspective view of part for joining main beams.
Figure 6:
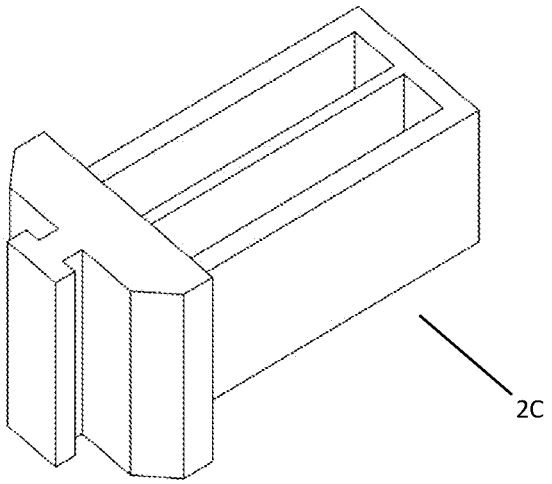
FIG. 6 represents a perspective view of a part for joining a main beam, for example, a horizontal beam, and another part for joining a main beam, for example, a vertical beam.
Figure 7:
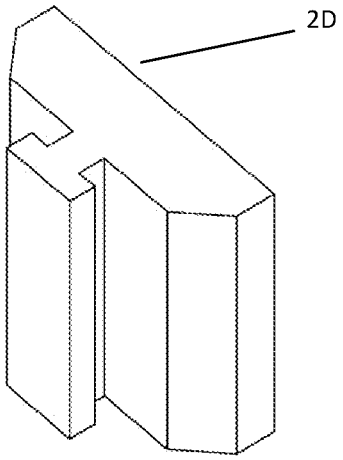
FIG. 7 represents a perspective view of a finishing element which can be arranged on a part for joining main beams.
Figure 8:
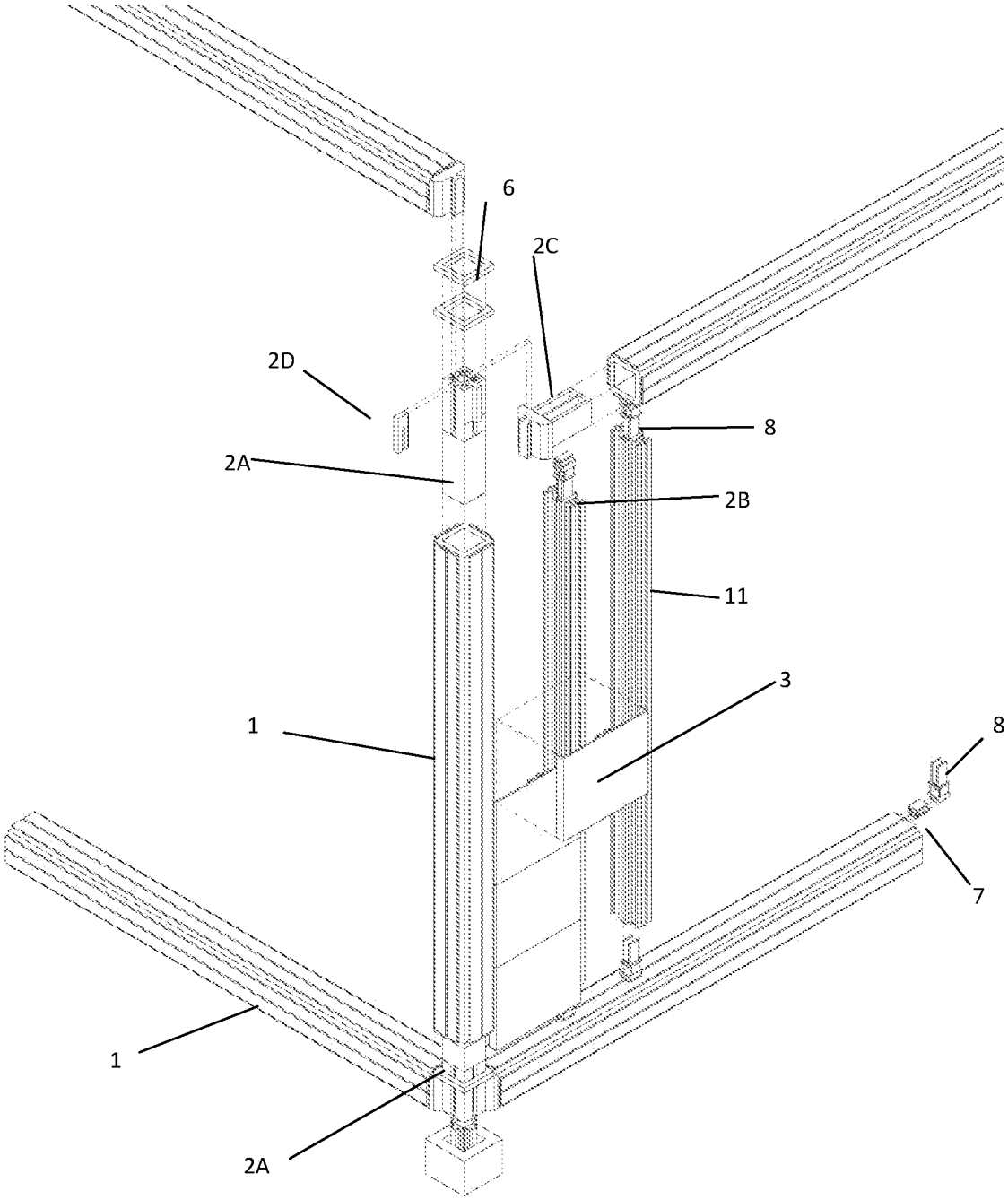
FIG. 8 represents a partial perspective view of the assembly of a construction module according to the present invention.

For example, as illustrated in FIG. 3, the corner part 2A is a junction part used to connect the main beams to each other by means of the other corner parts 2C (FIG. 6). The corner part 2A includes a square cross-section rod 4, shorter than the main beams, and insertable into the end of a first main beam. One end of this rod includes a longitudinal groove 5 in the center of each face of the square rod 4 intended to receive a projection on a junction element 2C (FIG. 6) insertable into the opening 5 (FIG. 3) of a second main beam which can be assembled end-to-end with the first.

In this example, this corner part 2A is intended to be positioned vertically and the main beams, which are connected to this corner part 2A, rest on a support ring 6.

Figure 4A:
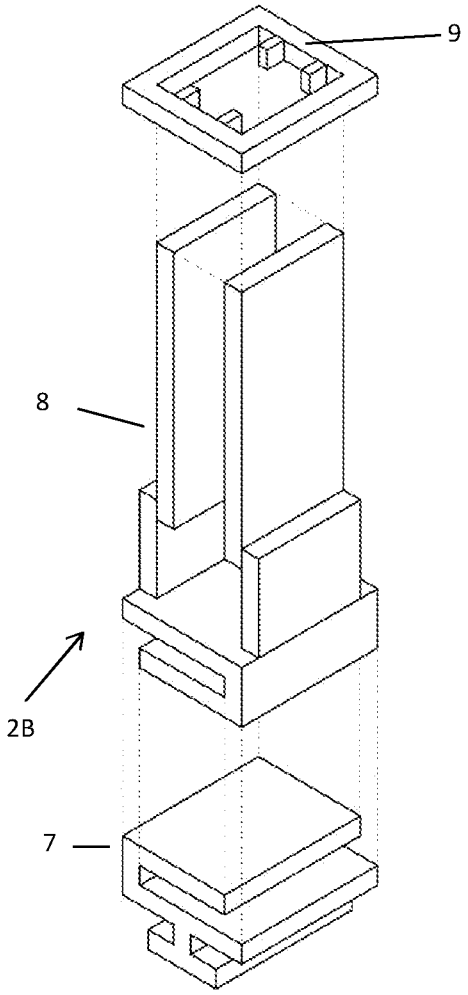
FIG. 4A represents a perspective view of a non-assembled junction part between a main beam and a secondary beam.
Figure 4B:
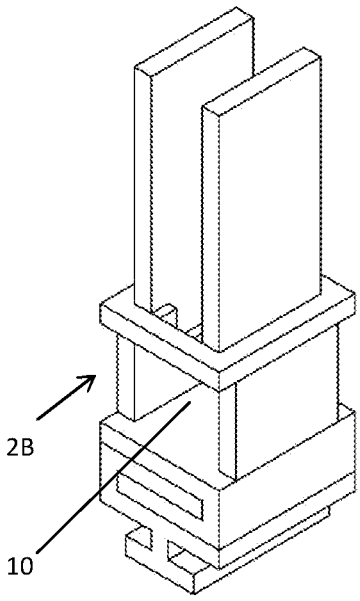
FIG. 4B represents a perspective view of the assembled FIG. 4A.

FIGS. 4A and 4B illustrate parts ensuring the junction between a main beam and a secondary beam. This junction part is broken down into three portions, a lower portion 7 which connects a vertical main beam to a central portion 8 that includes two projections intended to be inserted into a secondary beam. Finally, another holding ring 9 is arranged between the central portion 8 and the secondary beam. Besides, the space 10 created in this junction part 2B allows in particular electrical cables or other pipes to be integrated, in addition to an aeration system which will protrude from the opposite side of the secondary beam, in the same place, namely in the space 10 of another junction part 2B.

It is obvious that the construction module as illustrated in FIG. 9 requires openings in order to be used. Thus, either it is possible to leave free the total space occupied by a plate 3, for example using means for holding in position the plates 3, adjacent to the opening, or alternatively, the plate 3 includes removable areas to create openings.

Figure 10:
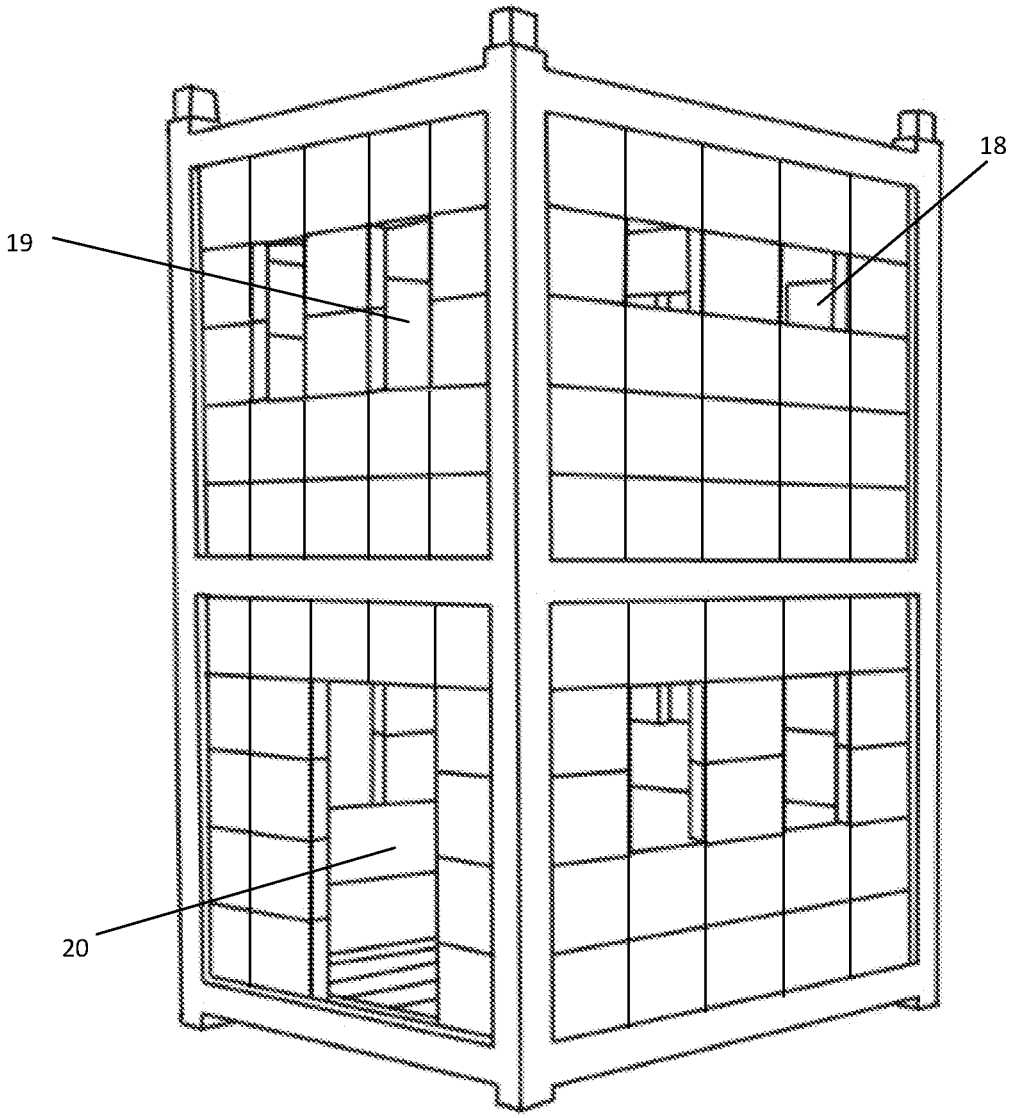
FIG. 10 represents two dwelling modules according to the present invention which are superimposed on top of each other and provided with windows and a door.

As illustrated in FIG. 10, two construction modules are superimposed on top of each other. In this example, when the assembly elements at the corner of the first construction module are sealed to the ground, the plates 3 resist wind up to 182 kg/m$^2$, the lower plates 3 support ground loads up to 224 kg/m$^2$ and the upper plates 3 of the second module support loads on the upper part of said second module up to 107 kg/m$^2$.

The upper dwelling module includes four openings that act as windows. Two small windows 18 are created by cutting two compartments on another plate 3'. Two large windows 19 are for example created by cutting out two compartments on two other plates 3 mounted on top of each other. The lower dwelling module has a large opening 20 serving as a door and two small openings 18 serving as windows. The door 20 is for example created by cutting two adjacent compartments 13 on four other plates mounted on top of each other. In this example, even if not visible, the common plates 3 between the bottom module and the upper module also include openings between the two modules. In another version which is not illustrated, an outer staircase can provide access to the upper housing module.

Thanks to the system of the present invention, it is possible to combine modules on top of each other but also next to each other. The assembly of the corner parts 2A, 2C (FIG. 3 and FIG. 6) and of the main beams 1 allow dwelling modules to be assembled in six directions, i.e. along the six faces of a rectangular dwelling module, and this with a minimum of parts since the corner parts 2A, 2C provide a junction between two construction modules without other intermediate parts.

For more comfort, the plates 3 spaced from each other form a formwork allowing an insulating material to be incorporated. It is also envisaged to incorporate electrical cables and piping and secondarily a tank thereto. The piping can be used both for transporting water to a water point disposed in said dwelling and for discharging waste-water outside said dwelling.

The upper portion of the module of a dwelling is always sealed either by a particular mounting of the plates or, in an example which is not illustrated, by the positioning of a tarpaulin on which a polymerizing resin can be applied making said tarpaulin rigid and waterproof. Such a structure is made using beams and columns. Each post and beam includes holes, in particular those in which screws are inserted, in which tubes of a cross-section corresponding to the holes are inserted. These tubes are long enough to constitute a structure which extends beyond the dwelling module in a manner sufficient to adjust the slope of a roof or a roof overhang depending on the geographic location of said dwelling module. Thus, once this structure for the roof has been made, one or more tarpaulin(s), possibly solar, can be disposed and stretched as, for example, a marquee-type tent is stretched.

Once the tarpaulin is stretched and shaped, the application of a transparent or colored resin, for example with a brush or a spray gun, should be carried out on the inner or outer portion of the tarpaulin. After polymerization, a thin but rigid and resistant and easily repairable resin shell is then obtained.

In another version that is not illustrated, the upper portion of the dwelling module can have a green roof.

In the illustrated example, the construction module includes four secondary beams per face, but in other variants, each module may include three or even two secondary beams.

A dwelling module according to the present invention has the advantage of being easy and quick to assemble and it is so robust that it meets the standards for load-bearing structures such as the standard EN1991.

In all the embodiments, the term «plastic material» means any material which can be recycled (HDPE, LDPE, PP, PET, PS, ABS . . . ). Of course, it is entirely possible to use non-recycled plastic material.

Regardless of whether the plastic material is recycled or not, the elements of the dwelling modules will be manufactured so as to be sufficiently resistant to support loads specific to dwellings. Thus, during their manufacture, the parts may include particular products or techniques promoting their rigidity.

The invention claimed is:

1. An assembly of at least one building construction module whose main elements are made of a plastic material, and which is constructed from a construction system, the construction system comprising:

a set of extruded, hollow profile main beams (1) made of plastic material, that are elongated and rectilinear, of a uniform rectangular cross-section and that are assembled end-to-end to form a rectangular open structure in the shape of a 3-dimensional rectangular frame;

a plurality of intermediate secondary beams (11) made of plastic material, and that are assembled between parallel and opposite main beams (1) of a rectangular frame, a plurality of flat facade elements (3) made of plastic material, the flat facade elements (3) being inserted between two adjacent parallel beams (1, 11), each facade element (3) including a rectangular flat plate provided with two folded opposite edges (3A) in hooking engagement with adjacent parallel beams (1,11), each rectangular cross-section main beam (1) including, on four flat sides thereof, a flat projection (21) parallel to a side of the main beam and dimensioned such that it is spaced from a portion of the side that is disposed towards the center of the side, leaving towards each corner of the main beam (1), an opening (22) that leads into a slot defined between the projection (21) and a facing surface of the main beam (1), said opening (22) and said slot receiving a folded edge (3A) of a flat facade element (3), said flat projections (21) and said openings (22) on the four flat sides of the main beam (1) extending lengthwise of the main beam (1) parallel to edges at the corners of the main beam (1), each secondary beam (11) including at least, on each of two opposite faces, a projection (23) leaving an opening (24) that leads into a slot in said projection (23) that receives a folded edge (3A) of a flat facade element (3), the construction system further comprising corner parts (2A, 2C) that are inserted and assembled between adjacent ends of the main beams (1) to form said rectangular open structure in the shape of a 3-dimensional rectangular frame in the form of a construction module that can be assembled with further-construction modules next to each other and/or above each other in six directions;

said assembly including:

a. at least one construction module formed of a three-dimensional rectangular frame of main beams (1), b. an assembly of secondary beams (11) between parallel main beams (1), and c. an assembly of flat facade elements (3) inserted between two parallel beams (1, 11), the folded edges of the facade elements being inserted into said openings (22) of the main beams (1) and said openings (24) of the secondary beams, wherein the secondary beams (11) are disposed vertically, parallel to and between vertical main beams (1), and said facade elements (3) are placed on top of each other between two vertical parallel main beams and secondary beams (1, 11).

2. The assembly according to claim 1, wherein the parallel projections (21) on each of the sides of the rectangular section of each main beam (1) do not extend up to the adjacent side of the rectangular section.

3. The assembly according to claim 1, wherein each main beam (1) includes on each side, two projections (21) parallel to the side and spaced from a portion of the side that is disposed towards the center of the side, the two projections (21) being divided by a central opening.

4. The assembly according to claim 1, wherein the secondary beams (11) include a square central hollow core and projections (21) extending on either side of this square hollow core, to define on each side, at least one opening (24) in each projection (21) leading into a slot for receiving the folded edge (3B) of a flat facade element (3).

5. The assembly according to claim 1, wherein each rectangular open structure in the shape of a 3-dimensional rectangular frame that constitutes a construction module which can be assembled with another module, measures between 2.5 m and 4.5 m in side length and in width and between 2.5 m and 3.5 m in height.

6. The assembly according to claim 1, wherein the flat facade elements (3) include, in their rectangular flat plates, removable areas to create openings.

7. The assembly according to claim 1, wherein the flat facade elements (3) each include two flat plates spaced from each other.

8. The assembly according to claim 1, wherein the construction system is made from recycled plastic materials.

9. The assembly according to claim 1, wherein each beam (1, 11) is filled with a substance reinforcing the structure thereof.

10. A residential building including an assembly according to claim 1.

* * * * *